United States Patent [19]

Watkins

[11] Patent Number: 5,008,024

[45] Date of Patent: Apr. 16, 1991

[54] MICROWAVE CORN POPPING PACKAGE

[75] Inventor: James D. Watkins, Prior Lake, Minn.

[73] Assignee: Golden Valley Microwave Foods Inc., Edina, Minn.

[21] Appl. No.: 497,190

[22] Filed: Mar. 22, 1990

[51] Int. Cl.[5] ..... H05B 6/80

[52] U.S. Cl. ..... 219/10.55 E; 219/10.55 F; 426/107; 426/113; 426/234; 426/243; 99/DIG. 14

[58] Field of Search ..... 219/10.55 E, 10.55 F, 219/10.55 R; 426/106, 107, 111, 113, 115, 234, 241, 243; 99/DIG. 14, 323.4, 323.5

[56] References Cited

U.S. PATENT DOCUMENTS

| | | | |
|---|---|---|---|
| 2,673,805 | 3/1953 | Coleman | 99/171 |
| 2,673,805 | 3/1953 | Colman | 99/171 |
| 2,815,883 | 12/1957 | Robins et al. | 220/66 |
| 2,819,976 | 1/1958 | Hines | 99/171 |
| 3,140,034 | 10/1961 | Wyman et al. | 229/3.5 |
| 3,519,439 | 7/1970 | Dunn | 99/171 |
| 3,671,270 | 8/1970 | Jehn | 99/171 |
| 3,782,976 | 1/1974 | Maier | 426/110 |
| 3,969,535 | 7/1976 | Bourns | 426/111 |
| 4,038,425 | 7/1977 | Brandberg et al. | 426/107 |
| 4,190,757 | 2/1980 | Turpin et al. | 219/10.55 E |
| 4,279,933 | 7/1981 | Austin et al. | 426/124 |
| 4,398,077 | 8/1983 | Freedman et al. | 219/10.55 E |
| 4,453,665 | 6/1984 | Roccaforte | 229/41 B |
| 4,584,202 | 4/1986 | Roccatorte | 426/111 |
| 4,586,649 | 5/1986 | Webinger | 229/114 |
| 4,612,431 | 9/1986 | Brown et al. | 219/10.55 E |
| 4,641,005 | 2/1987 | Sieferth | 219/10.55 E |
| 4,661,671 | 4/1987 | Maroszek | 219/10.55 E |
| 4,663,506 | 5/1987 | Bowen et al. | 219/10.55 E |
| 4,678,882 | 7/1987 | Borher | 219/10.55 E |
| 4,701,585 | 10/1987 | Stewart | 219/10.55 E |
| 4,734,288 | 3/1988 | Enastrom et al. | 426/107 |
| 4,735,513 | 4/1988 | Watkins et al. | 383/116 |
| 4,861,958 | 8/1989 | Borher | 219/10.55 E |

FOREIGN PATENT DOCUMENTS 2673805 3/1953

OTHER PUBLICATIONS

Jiffy Pop Microwave Popping Package American Home Products Inc. © 1986.

*Primary Examiner*—Philip H. Leung
*Attorney, Agent, or Firm*—James V. Harmon

[57] ABSTRACT

A package for popping popcorn in a microwave oven includes an open-topped container in the form of a tub formed from self-supporting microwave transparent sheet material such as stiff paper or paperboard. The tube includes an upstanding side wall terminating at the top in a free edge which defines an upper wide mouth. The side wall has a lower edge which rests on the floor of the microwave oven during cooking. The tube also includes a flat bottom wall which is connected to the side wall at an elevation spaced upwardly from its bottom edge to define an air compartment within the package between the botom wall of the package and the oven floor. A layer of microwave interactive susceptor material is connected to the bottom wall and is distributed across the bottom wall so that substantially the entire susceptor has a constant gap from the bottom wall of the oven. The lower edge of the side wall of the tub is uninterrupted to make possible a sealing engagement with the floor of the microwave oven so that the air in the compartment becomes heated during cooking. A layer of unpopped popcorn rests on the bottom wall in heat conductive relationship with the susceptor. A flexible cover formed from microwave transparent sheet material is sealed to the edge of the mouth of the tub. The cover expands upwardly as the kernels of popcorn pop to accommodate their expansion.

5 Claims, 1 Drawing Sheet

MICROWAVE CORN POPPING PACKAGE

FIELD OF THE INVENTION

The invention relates to microwave packaging and especially to a package suited for popping popcorn in a microwave oven.

BACKGROUND OF THE INVENTION

U.S. Pat. Nos. 4,861,958 and 4,678,882 describe a popcorn popping container in the form of a paperboard cup with a microwave lossy element added to the bottom of the cup either as a separate disc or as a laminate and with a lid having appertures for releasing moisture produced during popping. While the lossy element is intended to assist in popping the corn, neither the volume of popped corn produced nor the percentage of unpopped kernels have been as good as desired. Users are particularly disturbed when a substantial number of unpopped kernels or "old maids" remain after the popping process. It is therefore one object of the invention to make an improvement in the volume of popped corn and unpopped kernels produced in a package having the general form described in the aforesaid patents.

U.S. Pat. No. 4,586,649 describes a poping package in which the bottom of the package slopes centrally toward a central panel of small size. The carton resembles two truncated pyramids which are joined base-to-base and supported on a separate stand in the form of a collapsible tube. The sloping lower portion of the carton causes the corn to bunch together in a clump. In addition, the supporting stand must be manipulated by hand. This requires extra attention by the user and in the present state of development of the art is considered to be unsatisfactory because of the extra time, care and attention needed in setting up the package for popping. Moreover, many users have trouble following directions. Popping will be less satisfactory because the package also contains no susceptor. Finally, the distance between the package and the floor of the oven varies from one point to another because the bottom part of the package is sloped.

It is also known to provide a foil pan with an expandable cover for popping popcorn on a stove top. These packages are not suitable for use in a microwave oven because the metal foil pan acts as a shield. Examples are U.S. Pat. Nos. 3,519,439; 3,782,976 and 3,969,535.

Another popcorn package is described in U.S. Pat. No. 4,584,202. This package includes a paperboard carton with a top panel having a removable portion that is detached from the rest of the package just prior to popping. The unpopped popcorn is placed in a separate pouch which as it expands is pushed outside the carton through the top opening. The package contains no susceptor, and accordingly, popping of the corn will proceed at a relatively slow rate and may be incomplete. The use of a separate inner pouch makes the container more expensive. By now, the art has developed to a point at which the removal of a panel prior to popping is a deficiency that may render the product unacceptable to some users.

It is therefore a major object of the invention to provide an improved microwave popping package which requires no manipulation prior to use, from which popped corn can be eaten directly, which is capable of being stacked one inside another, and which provides a substantial improvement both in the volume of popped corn produced and also in the number of kernels that remain unpopped. A further object is to provide a popping package of the type described having a microwave interactive susceptor material distributed in heat conductive relationship with the popcorn and to find a way to strategically locate the entire susceptor in relationship to the supporting surface of the oven. Another object is to provide a spacing or gap between the susceptor and the oven floor that is related to the electrical characteristics of the oven for maximum energy transfer to the susceptor.

These and other more detailed and specific objects of the invention will be better understood by reference to the following detailed description and figures which illustrate by way of example but a few of the various forms of the invention within the scope of the appended claims.

THE FIGURES

SUMMARY OF THE INVENTION

Figure 1:
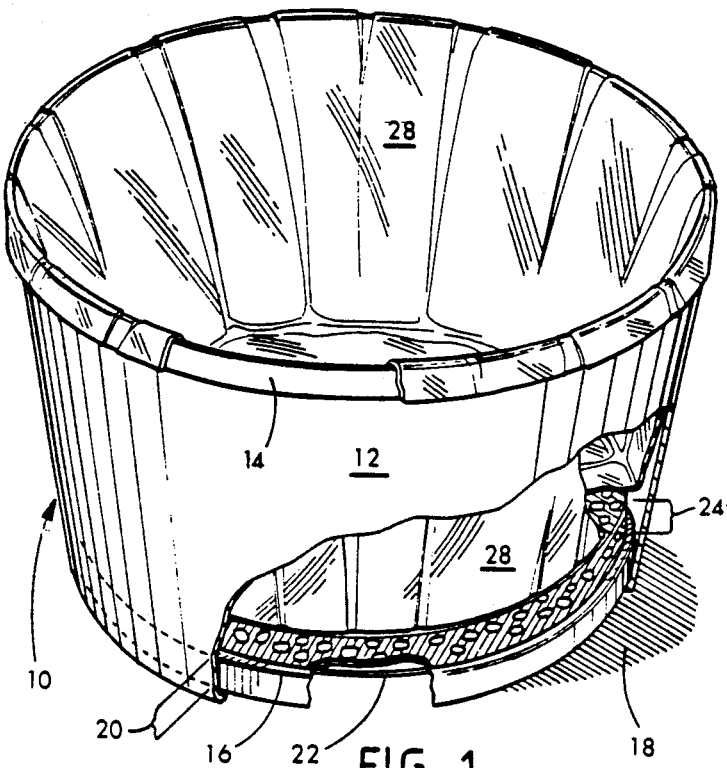
FIG. 1 is a perspective view of the invention partly broken away.

The invention provides a package for popping popcorn in a microwave oven. One major component is an open-topped wide mouth container in the form of a tub or bowl which is formed from self-supporting, preferably stiff microwave transparent sheet material such as paper or paperboard. The tub includes an upstanding side wall terminating at the top in a free edge which defines an upper wide mouth. The side walls of the tub slope outwardly to permit stacking of a plurality of such packages within one another during shipment and storage. The side walls have a lower edge which rests on the floor of the microwave oven during cooking.

The tub also includes a flat bottom wall. Above the bottom wall is a first compartment containing unpopped popcorn and optionally a quantity of vegetable oil or shortening. The bottom wall is connected to the side wall at a point spaced upwardly from its bottom edge so as to define a second compartment within the package providing an air space between the bottom wall of the package and the oven floor that has a substantially uniform height throughout. A layer of microwave interactive susceptor material is connected to the bottom wall and is distributed across the bottom wall so that the entire susceptor has a constant gap from the bottom wall of the oven to assist in popping the popcorn. The uniform height of the air gap between the susceptor and the oven floor facilitates the efficient transfer of microwave energy via the susceptor to the corn for enhancing popping of the corn.

The lower edge of the side wall of the tub is uninterrupted to make possible a sealing engagement with the floor of the microwave oven so that the air in the compartment is held below the package. As a result, the air in the air gap becomes heated above the temperature of the air in the oven which surrounds the package. This assists in the transfer of microwave energy to the susceptor. The unpopped popcorn contained in the upper compartment is in heat conductive relationship with the susceptor. A flexible cover is sealed to the top of the tub and expands upwardly as the kernels pop.

The susceptor can comprise any of a variety of microwave interactive materials such as a thin layer of metal, e.g. vapor deposited metal, metal oxide, carbon and the like known to the art. The susceptor can be applied directly to the bottom wall of the tub or can be supported upon a sheet of paper or plastic which is subsequently bonded to the bottom wall of the tub. One potentially suitable susceptor is a thin layer of plastic or paper having on it a dried layer of a liquid microwave interactive coating containing a microwave interactive component, e.g. carbon particles bonded together with a film former or matrix and microwave transparent electrically nonconductive attenuator particles. The susceptor layer can also be composed of a self-supporting coating adhered to the bottom wall and containing microwave interactive particles supported within a cured binder or matrix which holds the particles together and also bonds the susceptor coating to the surface of the bottom wall. Examples of such coatings are described in U.S. Pat. No. 4,267,420 and 4,190,757 and U.S. Pat. application Ser. Nos. 456,159 filed 12/22/89 or 261,380 filed 10/24/88.

DETAILED DESCRIPTION OF THE INVENTION

Figure 2:
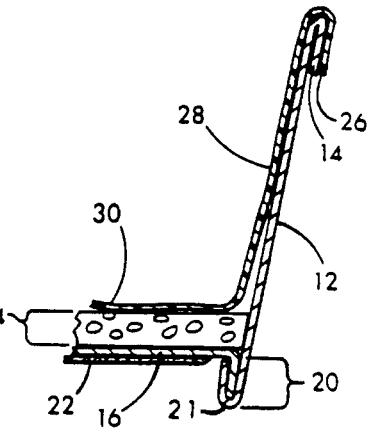
FIG. 2 is a partial vertical sectional view of a portion of the side and bottom wall of the package.

As shown in the figures, the package 10 comprises a bowl or tub-shaped container having an upstanding side wall 12 and a horizontal bottom wall 16 both of which can be formed from a stiff or semi-flexible material such as paper or paperboard. The side wall 12 is in this case circular, but other shapes are possible. As shown in FIGS. 1 and 2, the top edge of the tub is turned outwardly at 14 to define a reinforcing lip forming a circular wide mouth at the top of the side wall 12. The bottom wall 16 which is also circular is spaced upwardly from the oven floor 18 by a distance 20. The bottom wall 16 is thus bonded to the side wall 12 at a point above its lower edge 21. The bottom wall 16 can be made of stiff or flexible material such as paperboard or paper. As shown, its outer edge is folded downwardly and bonded to the side wall 12. Above the bottom wall 16 is a first compartment within the package which contains unpopped popcorn optionally mixed with a quantity of cooking oil or other shortening, indicated generally at 24.

Figure 3:
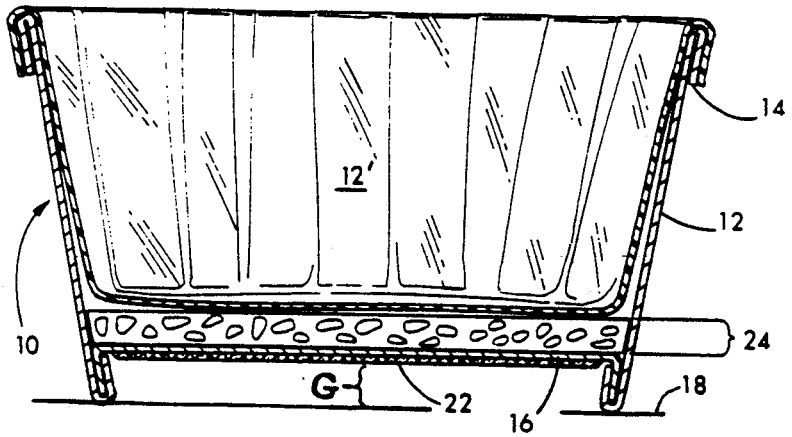
FIG. 3 is a central vertical sectional view of the package of FIG. 1.
Figure 4:
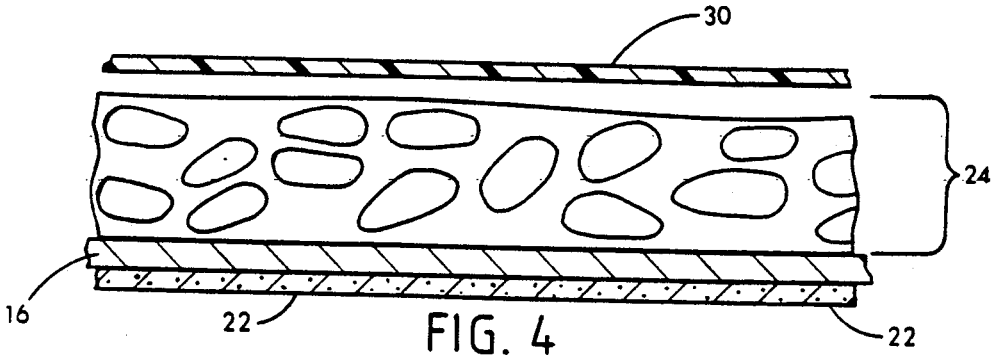
FIG. 4 is a partial vertical sectional view of the center portion of the package on a greatly enlarged scale.

The cover consists of a circular sheet of flexible microwave transparent material 12' (FIG. 3) having a portion 26 at the edge which is bonded by means of a suitable adhesive to the rim 14. The cover 12' has a peripheral portion 28 which conforms to the inner surface of the side wall 12 and a central portion 30 which rests against the upper surface of the charge of unpopped popcorn and shortening 24. During popping, the cover 12' expands upwardly as the kernels pop until it reaches a position approximately at the elevation of the upper edge of the rim 14 or slightly above it. The size of the tub and the charge of popcorn 24 are proportioned so that the popped corn will approximately fill or slightly exceed the volume of the tub. To serve the popcorn, all that is necessary is to remove the cover 12' by separating it from the upper rim 14 of the side wall 12. The tub then functions as a serving dish or bowl from which the popcorn can be eaten directly.

Since the side wall 12 of the tub is sloped outwardly, several of such packages can be stacked within one another during shipment and storage.

A suitable microwave interactive susceptor 22 is bonded to the bottom wall 16 of the tub and distributed across the center portion but not the edge portion that is folded downwardly and bonded to the lower part of side wall 12. It will be seen that both the bottom wall 16 and the susceptor 22 are positioned horizontally during use and are parallel to the floor of the oven 18. It will also be seen that the spacing between the bottom wall 16 and the bottom edge 21 of the side wall 12 defines a second compartment within the package below the bottom wall 16 to provide an air space between the bottom wall 16 of the package and the oven floor 18. This air space has a substantially uniform height throughout. As a result, the microwave interactive susceptor 22 connected to the bottom wall is positioned such that substantially the entire susceptor 22 has a constant gap G from the floor 18 of the microwave oven.

The lower edge 21 of the side wall 12 is uninterrupted to provide a sealing engagement with the floor of the microwave oven. As a result, air in the lower compartment is held within the confines of the side wall 12 and below the bottom wall 16. Air in the lower compartment will become heated during cooking above the temperature of the air in the oven. Because the gap G is of constant height their will be provided beneath the susceptor 22 a heated layer of air that serves as a dielectric layer having a constant height (gap G) throughout the entire susceptor 22. It is known that the dielectric constant of a substance will affect the microwave energy distribution through it. When the air in the gap G becomes heated, its dielectric constant will change primarily as a result of the expansion due to heating and the resulting reduction in the moisture content of the heated air. It is believed that the uniformity of the heated air layer in the gap G acting with the reduction in the dielectric constant of the air as it becomes heated helps to assure maximum microwave energy transfer to the susceptor 22.

Because microwave energy is reflected from surfaces, it has been found that energy peaks or nodes can occur at predetermined distances from a surface, as for example a predetermined distance from an oven wall that is partially or completely reflective of microwave energy.

In one form of the invention bottom wall 16 and susceptor 22 are placed at a strategic distance above the bottom edge 21 of the side wall 12 which is related to the electrical characteristics of the microwave energy. For example, in one form of the invention, the gap G is about one-eighth wavelength of the microwave energy supplied to the oven so that when the oven has a wavelength of 12 cm (which is typical of almost all ovens), the gap G is about 1.0 cm to 1.5 cm and preferably about 1.25 cm. In this way substantially the entire susceptor 22 has a constant gap G between itself and the floor of the oven 18, namely, about one-eighth of the wavelength of the microwave energy supplied to the oven. With respect to energy reflected upwardly onto the susceptor 22, there can thus be an energy reinforcement region or node which coincides with the location of the susceptor 22 which helps further to transfer the microwave energy efficiently to the susceptor 22 and then to the popcorn.

The effectiveness of the invention is shown in the following comparative examples. In each example a tub was formed from food grade paperboard. A cover was formed from a sheet of polyester film bonded with adhesive to the rim of the tub. The tubs were each loaded with 56 grams of unpopped popcorn and 23.5 grams of vegetable oil. In each case popping was accomplished in a 700 watt Litton microwave oven for 2 minutes and 35 seconds.

EXAMPLE 1

The Invention

This example demonstrates the results achieved with the invention as shown in the figures. The bottom wall 16 was placed about 7/16 inches (1.25 cm) above the lower edge 21 of the side wall 12 to provide a gap G between the susceptor 22 and the floor of the oven 18 of 1.25 cm. The oven had a wavelength of 12 cm. The results obtained in all examples are shown in Table 1 below.

COMPARATIVE EXAMPLE 2

A package was prepared the same as in Example 1 except that the portion of the side wall 12 extending below the bottom wall 16 was removed so that the bottom wall and susceptor rested against the floor of the oven.

COMPARATIVE EXAMPLE 3

A tub was prepared as in Example 1 except that portions of the side wall 12 below the bottom wall 16 were cut away and removed to leave four spaced apart remnants of the side wall which served as legs to hold the susceptor 22 the same distance from the oven floor as in Example 1 but allowed air to circulate freely beneath the susceptor.

COMPARATIVE EXAMPLE 4

A sample was prepared as in Example 1 except that no susceptor was provided. The results are shown in the following table.

TABLE 1

| | RESULTS | | |
|---|---|---|---|
| | Volume of Popped Corn (ml) | Unpopped Kernels (g) | Unpopped Kernels (%) |
| Example 1-Invention (G = 1.25 cm) | 2100 | 1.04 | 1.9 |
| Comparative Example 2: Bottom wall rests on oven floor (G = 0 cm) | 1900 | 7.43 | 13.3 |
| Comparative Example 3: Air allowed to circulate below susceptor (G = 1.25 cm) | 1950 | 4.05 | 7.2 |
| Comparative Example 4: No susceptor (G = 1.25 cm) | 1950 | 4.80 | 8.6 |

As can be seen in the table, the volume of popped corn that resulted from the invention was 2100 ml, or 150 ml greater than examples 3 and 4 and 200 ml greater than Example 2. This improvement provides the consumer with a substantially greater volume of popped corn. Even more importantly, the invention results in only 1.9% unpopped kernels. By comparison, Examples 2, 3 and 4 result in a much greater percentage of unpopped kernels, namely 13.3%, 7.2% and 8.6%, respectively. In other words, the number of kernels that remained unpopped in Example 3 is about 370% greater than the invention, and Example 4 is about 450% greater than the invention.

The air in the lower compartment beneath the susceptor in Example 1 reached a temperature of 198.4° C. after being heated for 2 minutes, 35 seconds. When no susceptor was used, the air in the compartment reached a temperature of 128.7° C. In the meantime, the air in the oven outside the package was raised from a temperature of about 20° C. before cooking to about 49.5° C. This shows that the air in the compartment beneath the susceptor is about 159° C. hotter than the air in the oven and about 70° C. hotter than achieved with a similar package having no susceptor. This provides a change in the dielectric constant of the air through a gap of uniform height G between the susceptor and the oven floor which assists in the efficient transfer of microwave energy to the susceptor and to the popcorn.

It will be noted that the package does not have to be manipulated in any way prior to popping. It also provides a package from which the popcorn can be easily consumed directly, i.e. without the necessity of transferring it to another container. In addition, the popping performance as measured by the volume of popped kernels and the reduction in the number of unpopped kernels is substantially improved.

Many variations of the present invention within the scope of the appended claims will be apparent to those skilled in the art once the principles described herein are understood.

What is claimed is:

1. A nestable and disposable corn-popping package which requires no manipulation prior to popping corn in a microwave oven comprising, a tub-shaped container comprising a sheet of stiff or semi-flexible paper or paperboard closed upon itself in the form of an upright tube which defines upstanding side walls that slope outwardly toward the top to permit nesting of a plurality of such packages within one another during shipment and storage, the side wall terminates at the top in a free edge which defines an upper open wide mouth for the package, the side wall has a lower edge which rests on the floor of the microwave oven during cooking, a generally horizontal bottom wall having an edge connected to the side wall at an elevation spaced upwardly from the bottom edge of the side wall to define an upper food containing compartment and a lower compartment within the confines of the side wall between the bottom wall of the package and the floor of the microwave oven, a layer of microwave interactive suseptor material connected to the bottom wall and being distributed thereacross, the lower edge of the side wall is substantially continuous and uninterrupted to provide sealing engagement with the floor of the microwave oven to define a sealed compartment containing air which during cooking becomes heated above the temperature of the surrounding air in the oven, a layer of popcorn resting on the bottom wall within the upper compartment of the tub in heat conductive relationship with the suseptor and, a flexible cover formed from a microwave transparent material having a peripheral edge sealed to the upper wide mouth, said flexible cover being secured only to the upper free edge of the side wall and depending downwardly therefrom into the package, the flexible cover conforming to the inner aspect of the side wall and conforming substantially to the upper surface of the popcorn to provide a hollow space of substantial size within the package into which a similar container can be nested during stacking of said containers.

2. The package of claim 1 wherein the susceptor comprises a dried layer of a liquid microwave interactive coating layer applied to the lower surface of said bottom wall.

3. The package of claim 1 wherein the susceptor layer comprises a self-supporting coating adhered to the lower surface of the bottom wall and comprising particles of a microwave interactive substance and a cured binder holding the particles together and bonding the coating to the surface of the bottom wall.

4. The package of claim 1 wherein the bottom wall is spaced upwardly from the lower edge of the side wall by a distance of about one-eighth wavelength of the microwave energy supplied to the oven so that when the has a wavelength of 12 cm said distance is about 1.0 cm to 1.5 cm so that the entire susceptor has a gap G of about one-eighth wavelength of the microwave energy between itself and the bottom wall of the oven to assist in popping the popcorn.

5. The package of claim 1 wherein the susceptor is a thin layer of metal or a metal-containing composition bonded to the bottom wall.

* * * * *